United States Patent [19]

Bini

[11] 4,296,585

[45] Oct. 27, 1981

[54] PERMANENT WEATHER COVERS

[76] Inventor: Dante Bini, 48 Chandos St., Crows Nest, N.S.W. 2065, Australia

[21] Appl. No.: 37,925

[22] Filed: May 9, 1979

[30] Foreign Application Priority Data

May 30, 1978 [AU] Australia ..... PD4545

[51] Int. Cl.[3] ..... E04B 1/34

[52] U.S. Cl. ..... 52/745; 52/2; 52/81

[58] Field of Search ..... 52/2, 86, 80, 81, 745; 264/32

[56] References Cited

U.S. PATENT DOCUMENTS

| | | | |
|---|---|---|---|
| 2,826,157 | 3/1958 | Vartia | 52/2 |
| 3,057,368 | 10/1962 | Seaman | 52/2 |
| 3,106,772 | 10/1963 | Holcombe | 52/2 |
| 3,277,614 | 10/1966 | Marie | 52/2 |
| 3,315,343 | 4/1967 | Berg . | |
| 3,375,619 | 4/1968 | Harkamp . | |
| 3,448,748 | 6/1969 | Walrave . | |
| 3,676,976 | 7/1972 | McAllister | 52/2 |
| 3,710,806 | 1/1973 | Kelly et al. . | |
| 3,968,808 | 7/1976 | Zeigler | 52/81 |
| 3,973,370 | 8/1976 | McAllister | 52/81 |
| 4,026,313 | 7/1976 | Zeigler . | |

FOREIGN PATENT DOCUMENTS

| | | | |
|---|---|---|---|
| 2110157 | 3/1971 | Fed. Rep. of Germany | 52/81 |

*Primary Examiner*—Price C. Faw, Jr.
*Assistant Examiner*—Henry E. Raduazo
*Attorney, Agent, or Firm*—Naylor, Neal & Uilkema

[57] ABSTRACT

A method for forming a domed space frame, comprising assembling and pivotally interconnecting plural longitudinally extensible elongate elements into a planar grid frame array; pivotally anchoring ends of the elongate elements at the grid frame periphery; securing a gas-tight flexible extensible membrane to the grid frame; anchoring the membrane around the periphery of the grid frame in a gas-tight manner; and introducing pressurized gas under the membrane to inflate it and thereby raise the grid frame into a domed configuration, with a consequential extension of the elongate elements. When each elongate element has extended to a predetermined ultimate length, an arresting means associated therewith becomes operative and prevents any further change in the length of that elongate element. When all the elongate elements are so arrested, the gas pressure is released from beneath the membrane, and a self-supporting domed space frame is then available for use.

5 Claims, 21 Drawing Figures

FIG.1
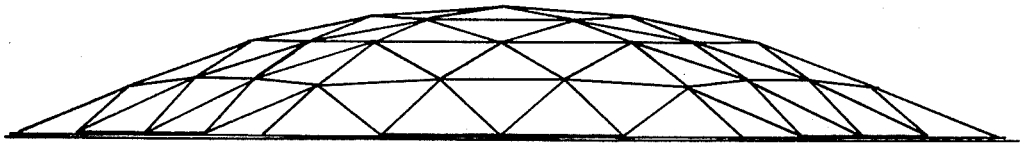
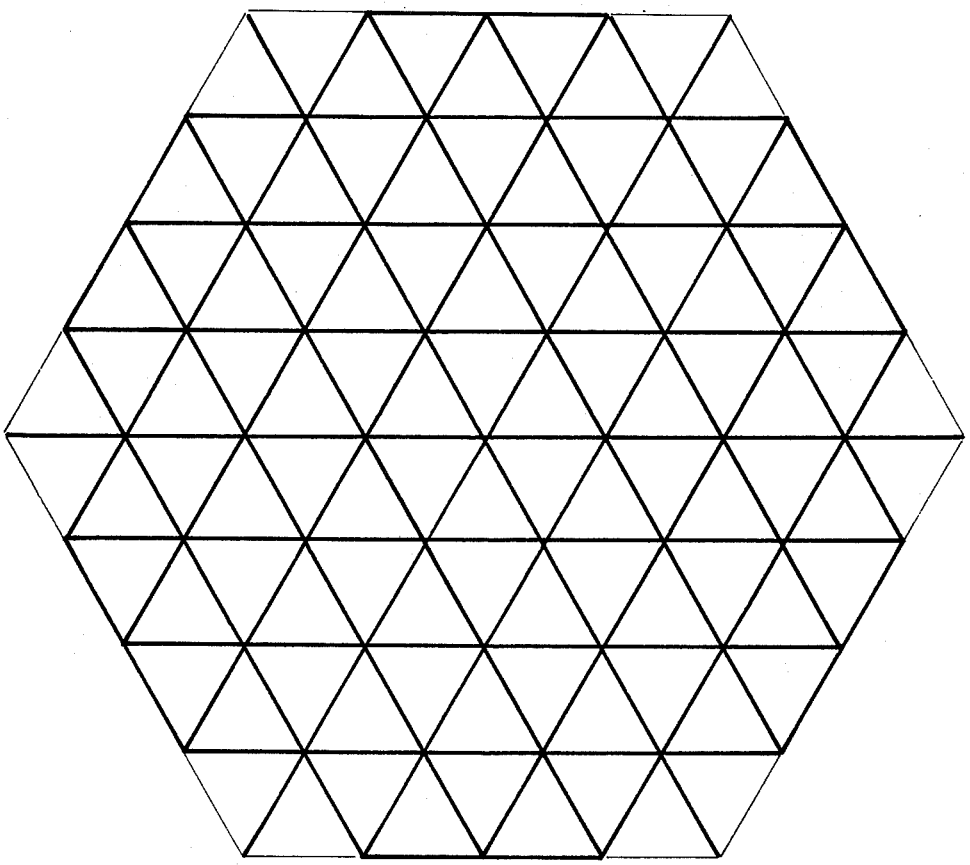
FIG.2

22
21
15
16
13
18
14
23
12
23
11
11
12
19
17
1
-3-
4
4
-3-
20

22
21
27
18
11
11
11
24
4
-1-
-3-
-3-
19
23
14
25
26

6
45
44
41
40
56
39
38
42
43
53
55
54

6
45
47
49
50
44
41
48
46
48
51
52
42
40

71
70
68
69
67
71
62
2
6
5
40
44
42
47

38
39
-6-
61
2
-60-

PERMANENT WEATHER COVERS

This invention provides a method, incorporating an inflation step, and apparatus to form a large all-weather cover for activity areas, exhibitions or storage areas. Examples would be a cover for an athletic or sports field, for a show place, a primary produce bulk depot or it may even be used as a cover for a container such as a water reservoir.

Inflatable covers for the above purposes are known, examples already existing are those covers which are maintained inflated in an erect condition by the continuous input of compressed air, "sprayed-on" concrete or foam domes using an inflatable membrane as a form work. Reinforced concrete domes and reinforced concrete skeletal domes with infills erected using inflation techniques are also known, (see my patents and patent applications relative to the last two forms of covers which are in use in more than ten countries of the world and known as Bini-Shell and Bini-Six Systems). The Bini-Shell and Bini-Six Systems involve raising a mass of reinforced wet concrete using low pressure compressed air.

Inflated covers which are maintained in the erect condition by a continuous input of compressed air are extremely vulnerable to vandalism and storm and accident damage which can produce substantial leaks of the inflating air. They are also vulnerable by virtue of other factors which might cause an interuption to the supply of compressed air.

Reinforced concrete domes, or reinforced concrete skeletal domes with infills, are very effective and durable but the erection thereof involves special equipment, special skills and ready availability of large quantities of concrete having special qualities and requiring very careful quality control.

This invention has the basic advantages of ease of manufacture for all the required components and simplicity of assembly and erection. The foregoing is achieved with limited quantities of material and energy. The cover may be offered as a package which can be assembled and anchored in a two dimensional form which is then inflated to take up its three dimensional form with the use of such simple apparatus as air blowers. Thus, the invention does not involve sophisticated technology and can be manufactured in areas remote from sophisticated industrial facilities and can be assembled and erected with the use of technically unskilled labour.

Broadly the invention provides a method of forming by air pressure a domed space-frame using elongated elements having a primary useable length and an ultimate useable length longer than the primary useable length and associated arresting means to permit increase of useable length from the primary to the ultimate and then prevent a further increase or a decrease in length; said method comprising the steps of assembling and pivotally interconnecting elongated elements to form a planar array of similar triangular frames which collectively define a grid having a generally hexagonal peripheral shape utilising the primary useable lengths of said elements, anchoring elements of the grid at the grid periphery at spaced locations in a manner permitting the grid at the anchoring points to pivot relative to the anchorages; securing a substantially gas tight flexible extensible membrane to the frame at a plurality of locations and so that the membrane extends beyond the grid periphery, anchoring the membrane periphery in a gas tight manner; introducing pressurised gas under the membrane to cause the membrane to be inflated and the grid attached thereto to be raised to take up a domed configuration with an associated increase in the useable length of the elements until the ultimate lengths are utilised and said arresting means becomes operative, and then releasing the gas pressure from beneath the membrane.

The invention also provides constructional arrangement to enable a domed space-frame to be erected, said arrangement comprising a plurality of elongated elements pivotally interconnected so as to form a planar array of similar triangular frames which collectively define a grid having a generally hexagonal peripheral shape, anchorage means whereby at least some of said elements of the grid at the periphery of the grid are anchored in a manner permitting pivotal movement of said at least some of said elements relative to the anchorage means, means to permit a predetermined increase in the length of the elements in the grid as the grid is elevated to become a domed space-frame and to prevent further increase when a predetermined increase has been achieved and prevent a decrease of that increase.

Several embodiments of the invention will now be described with reference to the accompanying drawings in which:

FIG. 1 is an illustration of how a cover in accordance with the invention will appear when erected;

FIG. 2 is a diagrammatic plan view (before erection) of a two dimensional grid made up of a plurality of like construction elements;

Figure 3:
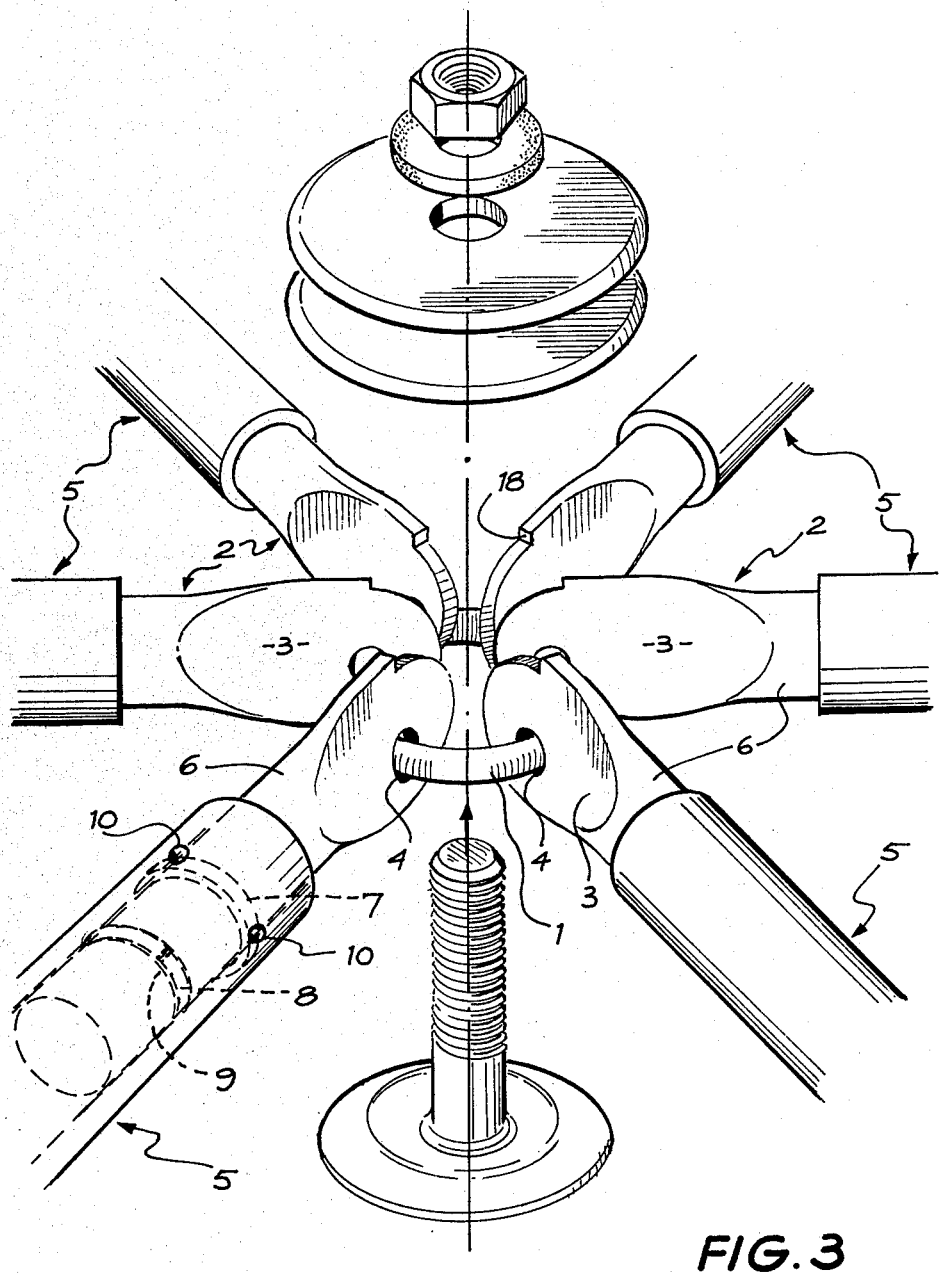
FIG. 3 is an exploded perspective view of one means of inter-connecting elements of the grid.
Figure 3A:
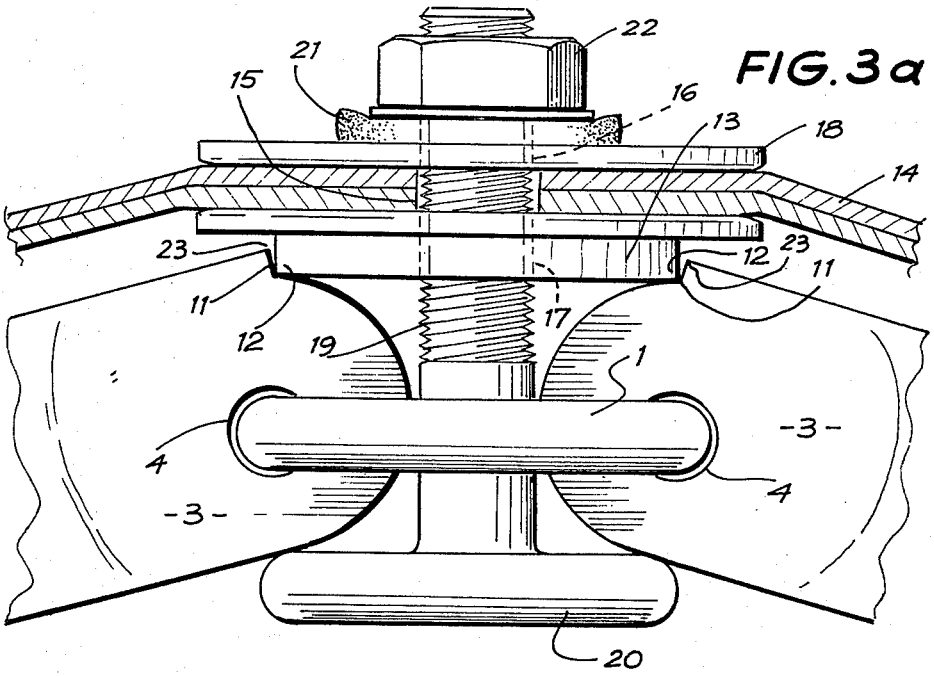
Figure 4:
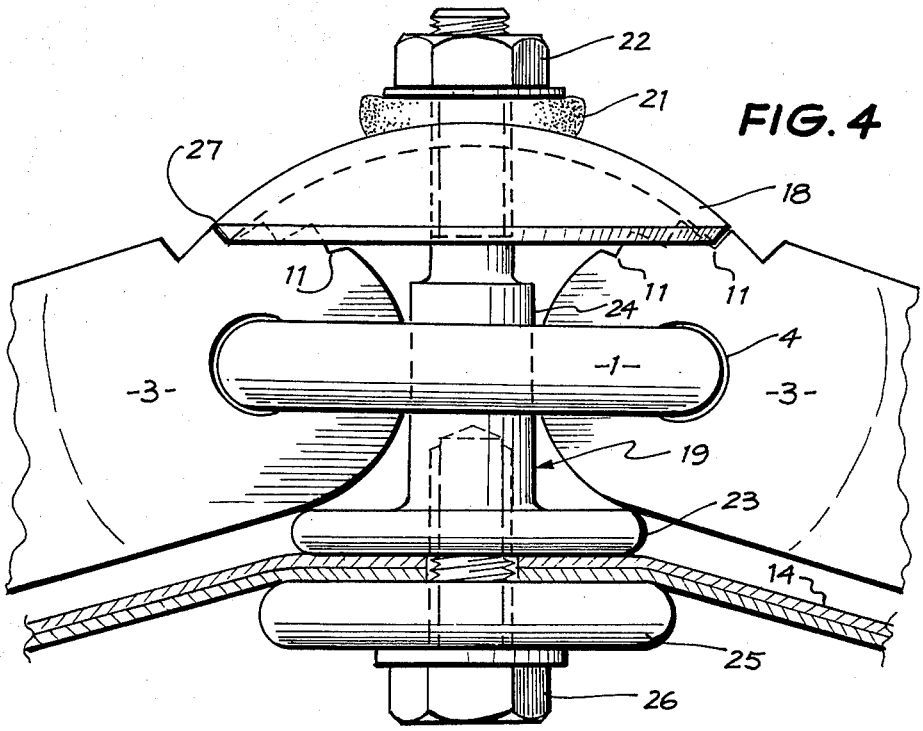
Figure 5:
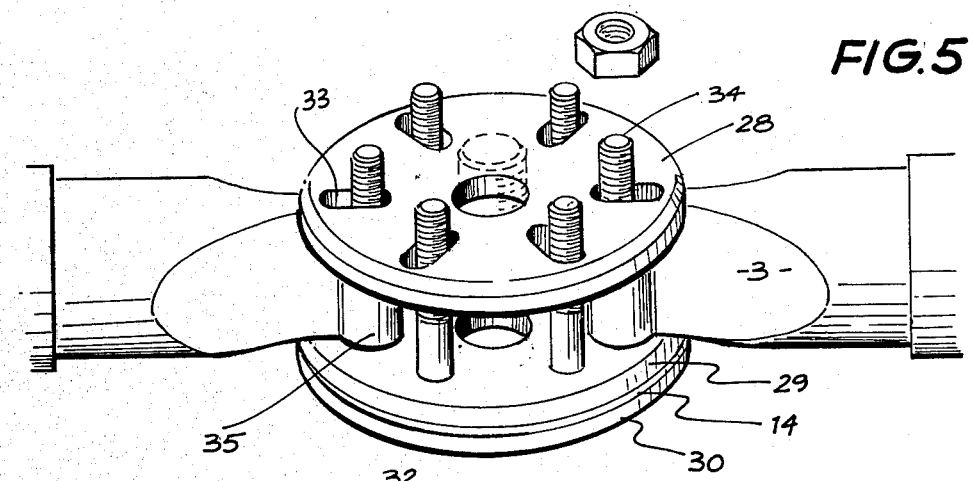
Figure 6:
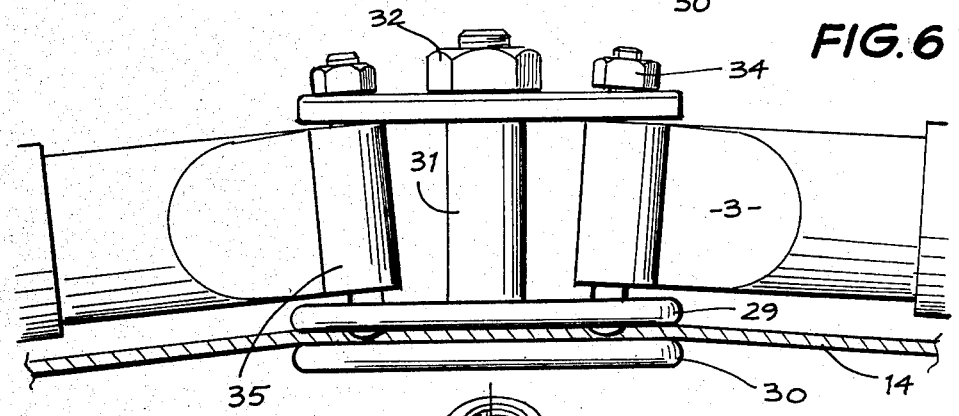
Figure 7:
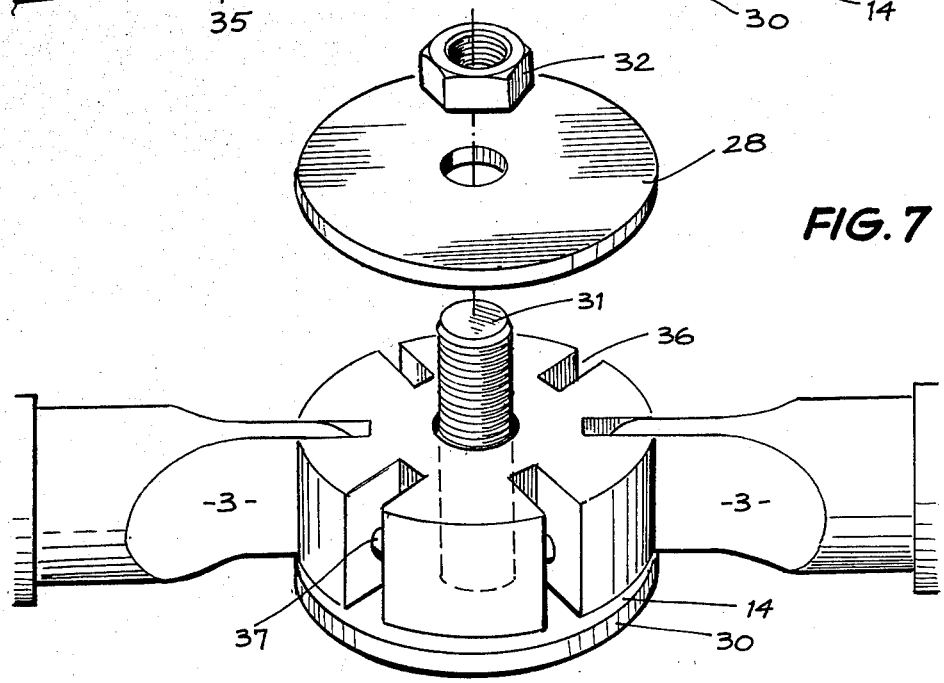
Figures 8, 9:
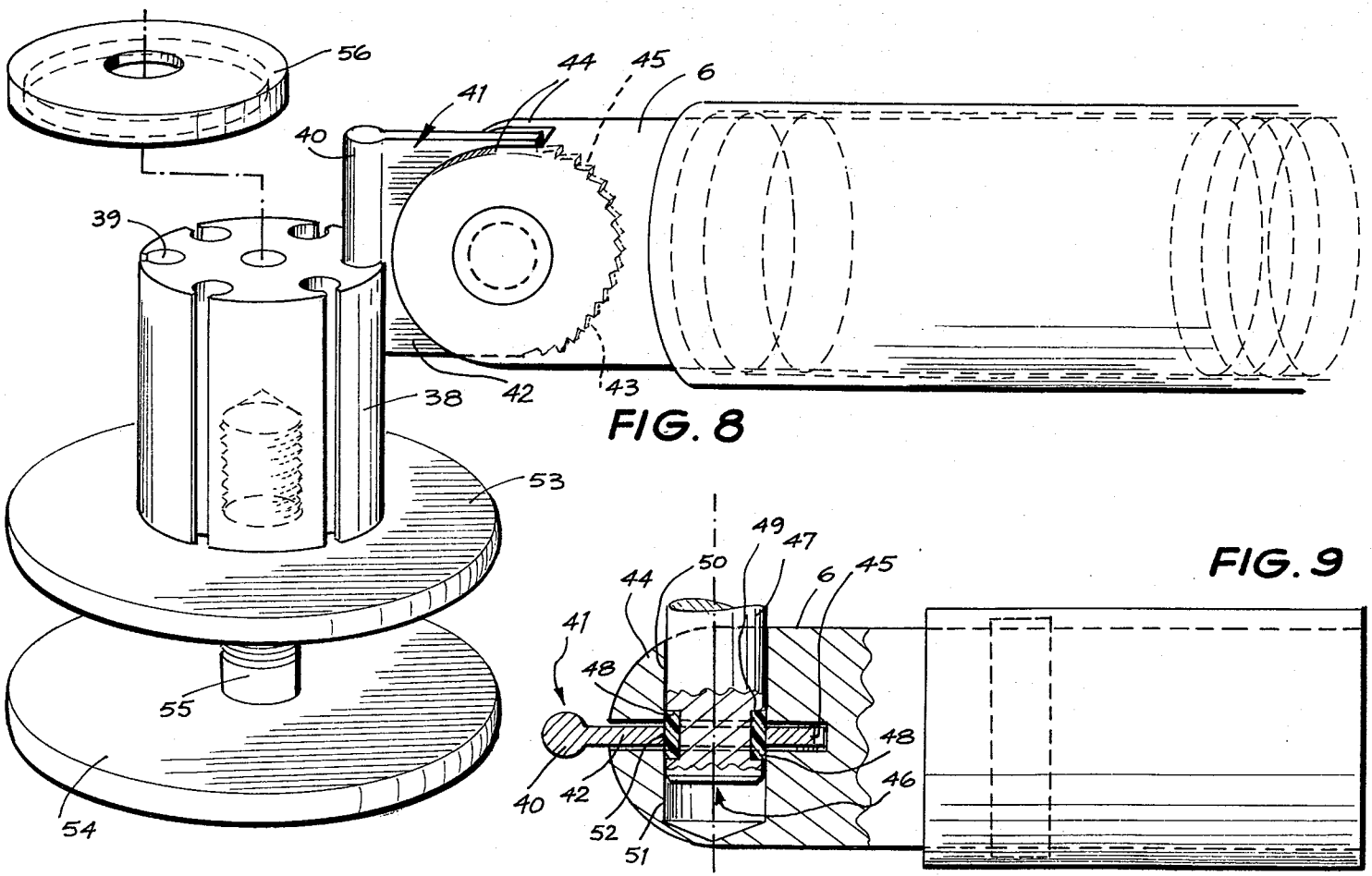
Figure 10A:
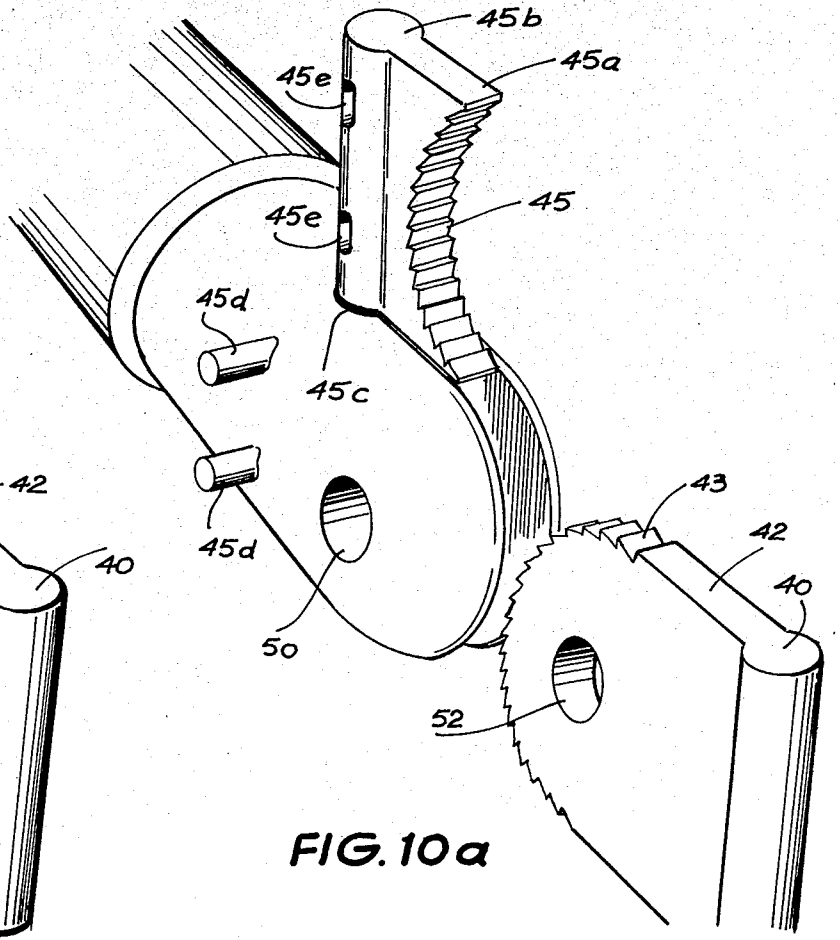
Figure 10:
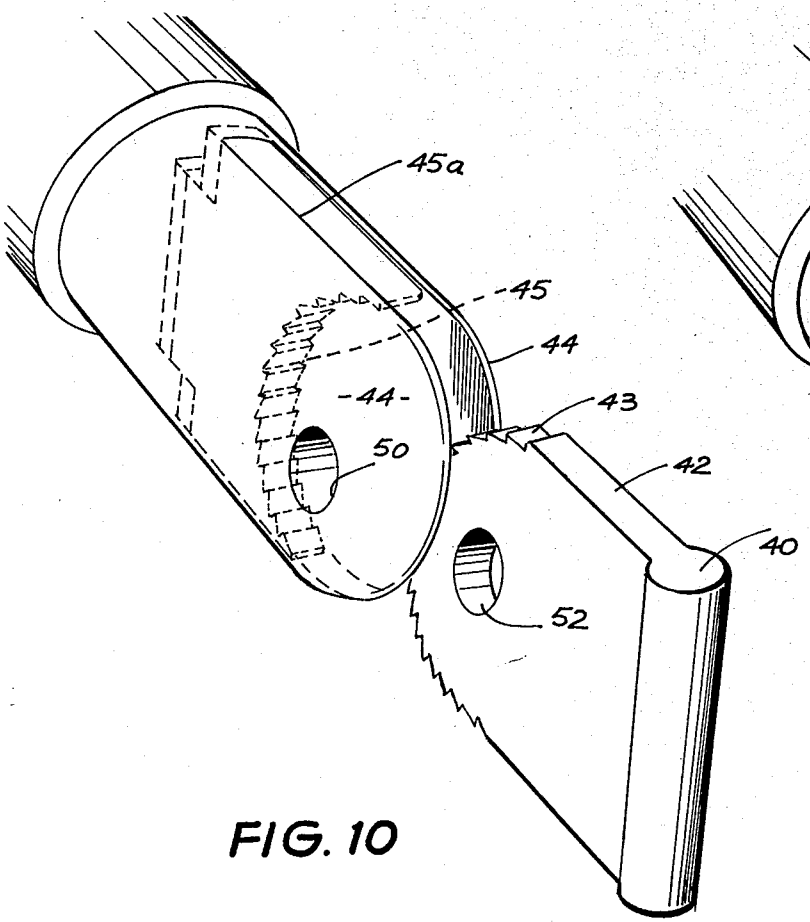
Figure 11:
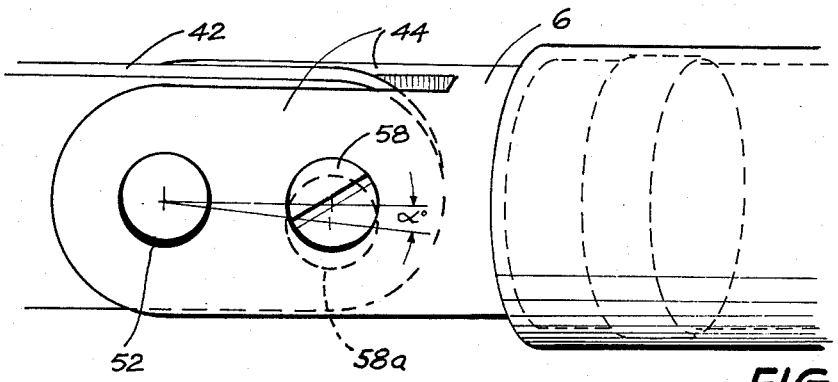
Figure 12:
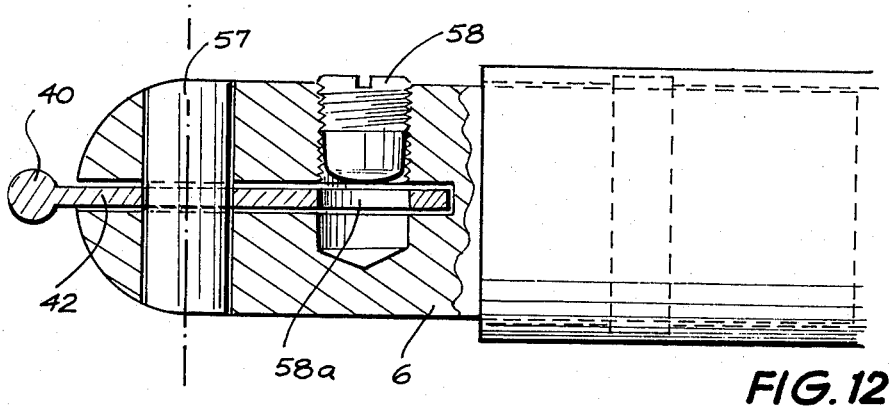
Figure 13:
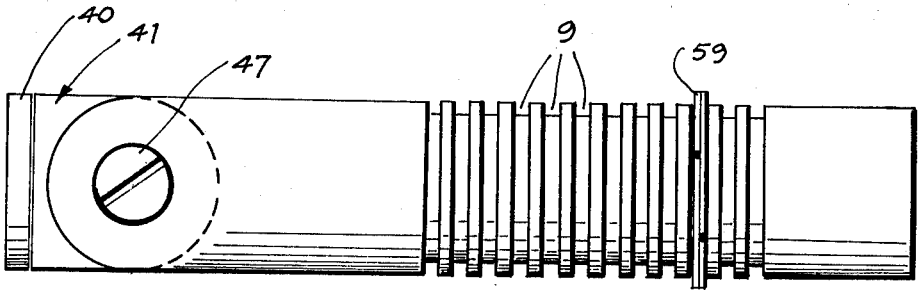
Figure 15:
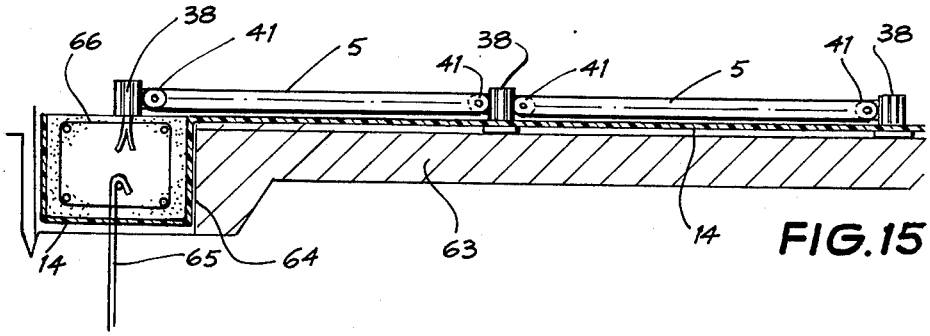
Figures 14, 16:
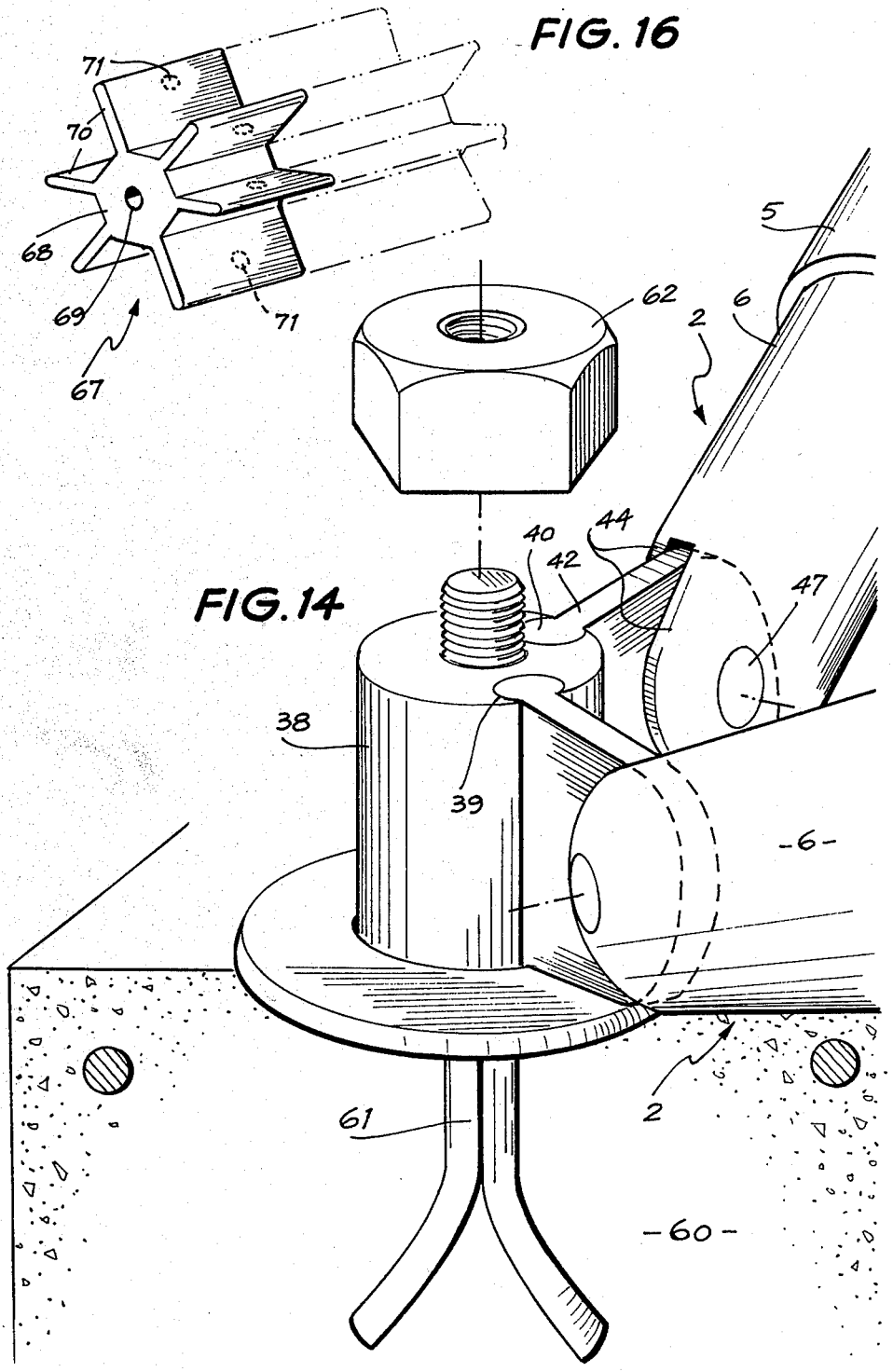

FIG. 3*a* is a side view of a connected group of components as shown in FIG. 3 as they will appear in an erected space frame and also shows a membrane fastened thereto;

FIG. 4 is a view similar to FIG. 3*a* showing a variation in the components and shows a membrane fastened in a different location;

FIG. 5 is a perspective view of different members for joining construction elements;

FIG. 6 is a view similar to FIG. 4 but showing the components of FIG. 5 for joining the construction elements;

FIG. 7 diagrammatically shows another type of joint for construction elements;

FIG. 8 is an exploded perspective view of another type of joint for construction elements and means for maintaining a required angular relationship between joined construction elements;

FIG. 9 is a sectional plan view of portions of the components shown in FIG. 8;

FIG. 10 is a perspective view of parts of a construction element showing the mounting of a toothed insert;

FIG. 10*a* is a view similar to FIG. 10 showing another way of mounting a toothed insert;

FIG. 11 is a fragmentary perspective view of parts of a construction element showing another means of maintaining a required angular relationship between joined construction elements;

FIG. 12 is a section plan view of portions of the components shown in FIG. 11;

FIG. 13 is a side view of a part of a construction element;

FIG. 14 is a fragmentary perspective view showing how the construction elements can be connected to a footing;

FIG. 15 is a diagrammatic sectional elevation showing the formation of a footing and the means for anchoring the membrane at its periphery;

FIG. 16 is a perspective view of a hub member for joining elements as it could be formed from an extruded metal section.

Figure 17:
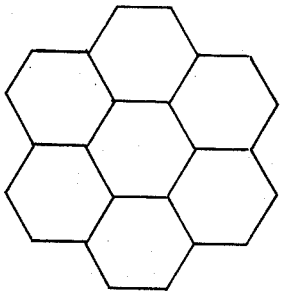
Figure 18:
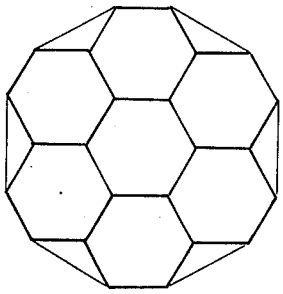
Figure 19:
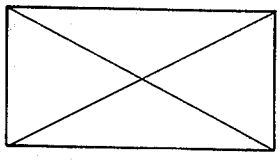

FIGS. 17 to 19 diagrammitically illustrate three other grid shapes.

FIG. 1 illustrates how a cover according to the invention will appear after it has been erected by inflation. FIG. 2 schematically illustrates an array of elements as required for the carrying out of the invention, prior to erection. FIG. 3 indicates means of joining elements of the grid of FIG. 2. There is provided a ring joiner 1, connectors 2 which are short lengths of pipe flattened as at 3 with holes 4 therein to loosely engage the ring 1. Links 5 are pipes in which the body 6 of the connectors 2 are slideably and rotatably housed. A connector 2 and a link 5 together constitute an element, as hereinafter claimed. There is an inner circumferential recess 7 in the bore of each link 5 to receive in snap locking engagement a circlip 8 mounted in a groove 9 in each connector body 6. Each circlip 8 is held contracted against a tendency to expand by engagement with the bore of the link 5. As soon as the circlip 8 is aligned with the groove 7 in the link 5 it snaps to an expanded condition to prevent further telescopic movement of the body 6 relative to the pipe 5 either in a contracting or expanding movement, while leaving body 6 and pipe 5 free for rotational twisting movement relative to one another about their longitudinal axes. To allow the insertion of the body 6 with its circlip 8 into the bore of the link 5 beyond the groove 7 there are four holes 10 aligned with the groove 7 to allow plungers to be inserted to compress the circlip 8 until it is entered into the link bore beyond the groove 7 and also to allow observation of the circlip to see if it is fully engaged in the groove 7.

The elements preferably, though not necessarily, have means operative after erection of the space frame to maintain a given angular relationship between adjacent elements. There is shown in FIG. 3*a* an arrangement of the component parts of FIG. 3 after erection of the space frame. The portions 3 have a top notch 11 which is engaged by a shoulder 12 on a washer 13. The washer 13 is part of a fastening means whereby the junction of elements is secured to a membrane 14. Specifically a membrane 14 has a hole 15 which is aligned with holes 16 and 17 of upper and lower washers 18 and 13. A bolt 19 with an enlarged head 20 passes through the ring 1 between the ends 3 of the connected elements, through washer hole 17, membrane hole 15, washer hole 16 and through resilient waterproofing washer 21 and is engaged in nut 22. The assembly is such that as the elements move from a planar alignment in the grid state to the angled arrangement of FIG. 3*a* the shoulders 12 ride over the corners 23, due to the compression of washers 21, until they snap down into the notches 11. This will allow an "overangle" to occur but when the pressure of gas below membrane 14 is released the space frame will settle to take up a permanent form when the shoulders 12 engage the notches 11 of all the element connections.

FIG. 4 shows an arrangement which is similar in purpose but different in detail. The membrane 14 is below the frame and is clamped between the head 23 of a modified bolt 19 having an enlarged body 24, and a washer 25 held in place by a bolt 26 screwed into head 23. The portions 3 have several notches 11, the washer 18 is domed to provide a peripheral rim 27 to replace shoulder 12 of washer 13. Again there is a resilient washer 21 and a nut 22.

FIGS. 5 to 7 illustrate two other element connections. FIGS. 5 and 6 have a hub comprising upper and lower washers 28–29. The membrane 14 is clamped between washer 29 and a bolt head 30 of a bolt 31. The top washer 28 has radial slots 33 and bolts 34 pass through eyes 35 on the element parts 3. When the space frame is erected the angle between elements is determined by the movement of the bolts 34 in slots 33. A nut 32 on bolt 31 maintains the members assembled.

In FIG. 7 the hub is a slotted member, the ends 3 of the elements are dimensioned to enter the slots 36 of the hub.

A ring member 37 passes through holes in the hub and the ends 3 to hold the assembly together. The membrane 14 is held to the hub by the head 30 of a bolt 31 (as before) retained in place by a nut 32 and a top washer 28.

FIG. 16 shows a spider element 67 which is an alternative to the hub of FIG. 7. The spider has a body 68 with a through hole 69 and radiating legs 70. The ends of the connectors 2 would be bifurcated and pivotally connected to the legs 70 by pivot pins in holes 71 in the legs 70. The spider could be cut from a length of extruded aluminium of the desired cross-sectional shape.

FIGS. 8, 9 and 10, considered collectively, show more sophisticated and preferred connection means. In FIG. 8 the hub 38 has a plurality of longitudinal peripheral key slots 39 to accept elongated part cylindrical key heads 40 of a coupler 41. Each coupler has a blade body 42 which, at the end opposite the head 40, has a generally semi-circular terminating portion with teeth 43. The connector 6 is bifurcated to provide two legs 44 with a toothed substantially semi-circular socket end 45. A pivot pin assembly 46 connects to blade 42 between legs 44. The assembly comprises a pin 47 with a resilient bush 48 in a groove 49 thereon. The pin 47 has portions housed in holes 50 and 51 in the legs 44 and the bush 48 is housed in a hole 52 in the blade 42. The positioning of the parts is such that the teeth 43–45 are in engagement. As the angular relationship between the blade 42 and the part 6 varies, due to the inflation of the membrane, the teeth 43–45 ride over each other due to the resilience of bush 48. When the required angular relationship is achieved the pin 47 is driven fully home into the hole 51. This causes the bush 48 to be crushed and prevents any further angular movement of the members 42 and 6 due to the now permanent inter-engagement of the teeth 43 and 45. The only way that angular relationships can change would be for the teeth 43 and 45 to strip.

The membrane 14 is held secured between a washer 53, below hub 38, and the head 54 of a bolt 55. The key heads 40 are held in the key slots by a washer 56 also secured by bolt 55.

In FIGS. 10 and 10*a* it will be seen that the teeth 45 are on an insert block 45*a* which fits into the base of the bifurcation between legs 44.

In the FIG. 10 drawings the block 45*a* is seated on rubber 48*a* which is the equivalent of bush 48 (not used) in its effect allowing the teeth 43–45 to ride over each other. The teeth are however in this case of "buttress" form having one inclined face and one upright face.

Thus "riding over" is facilitated by the included faces (for one direction of movement) but the opposite direction of movement is prevented by the upright faces of teeth 43–45 abutting.

In FIG. 10*a* the block 45*a* has a keyhead 45*b* to engage a key slot 45*c* where it is held by pins 45*d* which enter holes 45*e*. The pin 47 would in this embodiment utilise a bush 48. The teeth 43–45 may be of "buttress" form.

In FIGS. 11 and 12 the blade 42 is positively connected by a pivot pin 57 to legs 44 and a screw 58 in one leg 44 is screwed into a hole 58 in blade 4 when the correct angular relationship between blade 42 and member 6 is achieved. The location of the hole 58 is predetermined at the time of manufacture of the parts to give the desired angular relationship between the blade 42 and the member 6.

In modifications of basic elements the circlip 8 can be made of multiple like elements i.e., several narrow rings similar to the form of a compression ring of a piston in an automobile engine. This is illustrated in FIG. 13 where the split ring is indicated at 59. It is to be noted that the single groove 9 on the body 6 (FIG. 3) has been replaced by a plurality of grooves 9. This enables parts to be prefabricated and the required groove 9 utilised in the assembly of the components. Differently located grooves 9 will be required in various parts of the grid where greater or lesser expansion is required.

The mode of pivotally connecting a grid made up of interconnected elements at its periphery to a footing may be of many forms. One preferred method is illustrated in FIG. 14. This arrangement follows very closely that illustrated in FIG. 8. The links 5 each have a connector 2 bifurcated at one end to provide the legs 44. A blade 42 is pivoted by a pin 47. Each blade 42 has its enlarged key head 40 engaged in key slot 39. The hub 38 and washer 53 are as previously described. The hub and washer are secured to the footing 60, which encircles the area to be covered, by passing the hub central hole over a bolt 61 embedded in the footing 60. The assembly being completed by means of a large nut 62 which overlaps the keyheads 40 thus preventing them being disengaged from the key slots 39.

Turning now to the mode of assembly and utilisation of the components previously described. In FIG. 15 there is shown a section of a surface 63 to be covered, a peripheral trench 64, which will form a hexagonal ring beam around the surface 63, anchor bar 65 in the ground, reinforcing 66 and engaged bolts 61 to be connected to hubs 38 (see FIG. 14). The membrane 14 is located in the trench 64 as illustrated and the trench 64 is filled with concrete to secure the membrane periphery and also provide the footing 60. Compressed gas is then introduced under the membrane and the erection and locking of the elements is subsequently released to provide a finished clad domed space-frame.

The various elements and parts of the frame hereinbefore described may be of metal or may in many instances be of plastics materials.

Whilst telescopic members as hereinbefore described are preferred other telescopic arrangements may be used.

By way of exemplifying the versatility of the present invention the following uses are given.

| | | |
|---|---|---|
| SPORTS FACILITIES: | Indoor Tennis Court<br>Gymnasia | Sports Halls<br>Sports Centres |

-continued

| | | |
|---|---|---|
| | Swimming Pools | |
| SCHOOLS: | Play Schools | Nursery Schools |
| OVER-ALL | Primary Schools | Theatres |
| COVER FOR | Campus situations | |
| PUBLIC ENTER- | Community Halls | Cultural Centres |
| TAINMENT: | Social Centres | Pop Concert Halls |
| | Outdoor Restaurants | Clubs, B.B.Q. |
| | Discoteques | Cinemas, Theatres |
| COMMERCIAL | Agricultural Super- | Shopping Centres |
| BUILDINGS: | markets | |
| | Exhibition Halls | |
| | Areas & Filling | |
| | Stations | |
| AGRICULTURAL | Food Storage | |
| BUILDINGS: | | |
| STORAGE | Warehouse | |
| BUILDINGS: | Bulk Storage | Granular Storage |
| INDUSTRY: | Specialist Manufacturing Facilities | |
| EMERGENCY AC- | High Speed, Low Cost Buildings | |
| COMMODATION: | | |
| MILITARY | Instant covers of any size | |
| FACILITIES: | | |

In some of the above applications it may be desirable to modify the constructions described. For example it may be desirable to have a membrane both above and below the space frame or it may be desirable to have a membrane sandwiched between two space frames suitable inter-connected. Naturally combinations of the foregoing could also be possible.

In some cases, where the membrane is below the grid, it may not be necessary to fasten the membrane to the grid.

Several configurations possible for the grid are shown diagramatically in FIGS. 17 to 19.

It is also within the scope of the invention to have elements which are not extensible joined to elements which are extensible to form a grid.

I claim:

1. A method of forming a self-supporting domed space frame comprising the steps of:

(a) taking a plurality of elongated longitudinal elements, each of said elements having a longitudinal axis and opposed ends and at last some of said elements being extensible and having (i) a minimum length and an operative length greater than said minimum length, and (ii) arresting means to prevent a reduction in the length of the element to a value less than said operative length, said arresting means being automatically operable when the element has had its length increased to a value not less than said operative length;

(b) assembling said elements into a substantially planar grid, wherein (i) an end of each element is pivotally connected to an end of the next adjacent element for pivotal movement about a horizontal axis extending transversely of said elements, and (ii) the elements are free to twist about the longitudinal axes thereof;

(c) anchoring elements of the grid at the grid periphery in a manner permitting such anchored elements to swing upwardly;

(d) locating an inflatable membrane in lifting relationship to the grid;

(e) inflating the membrane to lift the grid to a point wherein all of the extensible elements have been extended to at least their respective operative lengths;

(f) locking at least certain of the elements against return pivotal movement about said transversely extending axes; and, (g) releasing the inflation pressure from the membrane to permit said gridwork to be self-supporting.

2. A method of forming a domed space frame as claimed in claim 1 wherein the membrane is disposed over the grid and fastened to the grid at a plurality of locations.

3. A method of forming a self-supporting domed space frame comprising the steps of:

(a) taking a plurality of elongated longitudinal elements having two opposed ends and a longitudinal axis, at least some of which elements are extensible between a collapsed length and an operative length after said elements have been extended to at least that length;

(b) assembling said elements into a substantially planar grid, wherein (i) an end of each element is pivotally connected to an end of the next adjacent element for pivotal movement about a horizontal axis extending transversely of said elements, and (ii) the elements are free to twist about the longitudinal axes thereof;

(c) anchoring elements of the grid at the grid periphery in a manner permitting such anchored elements to swing upwardly;

(d) creating a superimposition of an inflatable membrane and the grid;

(e) inflating the membrane to lift the grid to a point wherein all of the extensible elements have been extended to at least the operative length;

(f) locking at least certain of the elements against return pivotal movement about said transversely extending axes; and, (g) releasing the inflation pressure from the membrane.

4. A method of forming a domed space frame as claimed in claim 3 including the step of fastening the membrane to the grid at a plurality of locations.

5. A method of forming by inflation a self-supporting domed space frame using elongated extensible elements having two opposed ends and a longitudinal axis and being provided with associated arresting means to permit extension of the elements from an initial contracted condition and limit contraction of said elements to a predetermined extended operative length after extension of said elements to at least said length, said method comprising the steps of pivotally interconnecting the ends of said elements while the elements are in the initial contracted condition to form a planar array of frames which collectively define a grid wherein the connected elements are free to pivot relative to one another about both horizontally disposed transversely extending axes at the ends thereof and the longitudinally extending axes thereof; anchoring elements of the grid at the grid periphery in a manner permitting such anchored elements to swing upwardly; locating an inflatable membrane in lifting relationship to said grid; introducing pressurized gas under the membrane to cause the membrane to be inflated and the grid to be raised to take up a domed configuration with associated extension of the elements until at least the operative lengths are achieved and said arresting means can become operative; locking at least certain of the elements against return pivotal about said transversely extending axes; and then releasing the inflation pressure.

* * * * *